US011444403B2

(12) United States Patent
Song et al.

(10) Patent No.: US 11,444,403 B2
(45) Date of Patent: Sep. 13, 2022

(54) TERMINAL ASSEMBLY AND ELECTRICAL CONNECTOR

(71) Applicant: Dongguan Luxshare Technologies Co., Ltd, Dongguan (CN)

(72) Inventors: Tao Song, Dongguan (CN); ChenHui Zeng, Dongguan (CN); RongZhe Guo, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/308,364

(22) Filed: May 5, 2021

(65) Prior Publication Data

US 2021/0376514 A1 Dec. 2, 2021

(30) Foreign Application Priority Data

May 28, 2020 (CN) ..... 202010470610.3

(51) Int. Cl.
*H01R 13/24* (2006.01)
*H01R 13/40* (2006.01)
(Continued)

(52) U.S. Cl.
CPC ..... *H01R 13/2428* (2013.01); *H01R 13/40* (2013.01); *H01R 13/502* (2013.01); *H01R 13/6273* (2013.01)

(58) Field of Classification Search
CPC ..... H01B 9/001; H01R 13/2421; H01R 13/2428; H01R 13/6275; H01R 13/22;
(Continued)

(56) References Cited

U.S. PATENT DOCUMENTS 2,619,515 A * 11/1952 Doane ..... H01R 13/4536 439/903
4,778,404 A 10/1988 Pass
(Continued)

FOREIGN PATENT DOCUMENTS

CN 1476655 A 2/2004
CN 2618320 Y 5/2004
(Continued)

OTHER PUBLICATIONS

Office Action issued in Chinese Application No. 202010470610.3, dated Feb. 20, 2021.

*Primary Examiner* — Abdullah A Riyami
*Assistant Examiner* — Nader J Alhawamdeh
(74) *Attorney, Agent, or Firm* — Birch, Stewart, Kolasch & Birch, LLP

(57) ABSTRACT

The present disclosure provides a terminal assembly, which comprises a first terminal component, a second terminal component, and an elastic member. The first terminal component comprises a first flat terminal, which comprises a cable connecting end part and a first contacting end part. The second terminal component is disposed on one side of the first terminal component. The second terminal component comprises a second flat terminal including a second contacting end part and an electrical connecting end part. The first contacting end part is contacting with the second contacting end part. Two ends of the elastic member are respectively connected to the first terminal component and the second terminal component. The second terminal component is able to move toward or move away with respect to the first terminal component through the elastic member. The first contacting end part is frictionally contacting with the second contacting end part.

20 Claims, 10 Drawing Sheets

(51) Int. Cl.
*H01R 13/502* (2006.01)
*H01R 13/627* (2006.01)

(58) Field of Classification Search
CPC ..... H01R 13/6315; H01R 13/24; H01R 13/5219; H01R 13/5227; H01R 13/64; H01R 13/719; H01R 2103/00; H01R 24/28; H01R 24/76; H01R 12/58; H01R 12/707; H01R 12/716; H01R 12/718; H01R 12/737; H01R 12/75; H01R 13/025; H01R 13/052; H01R 13/33; H01R 13/424; H01R 13/4536
See application file for complete search history.

(56) References Cited

U.S. PATENT DOCUMENTS 4,865,558 A * 9/1989 Stoner ..... H01R 13/6315 439/246
5,632,655 A * 5/1997 DeMarco, Jr. ..... H01R 13/434 439/655
6,033,247 A * 3/2000 Gregory, II ..... H01R 13/6315 439/247
6,116,945 A * 9/2000 Davis ..... H01R 13/5825 439/598
6,290,512 B1 * 9/2001 Mullen, Jr. ..... H01R 13/506 439/106
6,992,496 B2 * 1/2006 Winter ..... G01R 1/0441 324/756.07
7,785,153 B2 * 8/2010 Wang ..... H01R 13/506 439/668
8,573,983 B2 * 11/2013 Zieder ..... H01R 11/09 439/8
8,888,535 B2 * 11/2014 Knight ..... H01R 13/5221 439/650
2004/0043641 A1 * 3/2004 Kosmala ..... H01R 12/73 439/66
2015/0280356 A1 * 10/2015 Jové Albós ..... H01R 13/504 29/858
2019/0027855 A1 * 1/2019 Dai ..... H01R 13/424

FOREIGN PATENT DOCUMENTS

CN 1744387 A 3/2006
CN 101501509 A * 8/2009 ..... G01R 1/0466
CN 108736193 A 11/2018

* cited by examiner

TERMINAL ASSEMBLY AND ELECTRICAL CONNECTOR

CROSS REFERENCE TO RELATED APPLICATION

This application claims the priority benefit of Chinese Patent Application Serial Number CN 202010470610.3, filed on May 28, 2020, the full disclosure of which is incorporated herein by reference.

BACKGROUND

Technical Field

The present disclosure relates to the technical field of connectors, particularly to a terminal assembly and electrical connector.

Related Art

Conventional connection types for a cable to be connected with a circuit board through a terminal assembly are, for example, press-fit, soldering, and elastic contacting, etc. The elastic contacting for a cable to be contacting with a circuit board through a terminal assembly is that the contacting terminal of the terminal assembly comprises an elastic contacting component which is exposed from an insulating body and is elastically in contact with a circuit board. To improve the structural strength of the elastic component, the size of which should be increased accordingly. Thus, the size of the terminal assembly would be increased, and the size of the connector to which this terminal assembly is installed also to be increased.

SUMMARY

The embodiments of the present disclosure provide a terminal assembly and connector to solve the problem of excessive bulkiness of the terminal assembly for conventional elastic contacts.

On the first aspect, the present disclosure provides a terminal assembly, which comprises a first terminal component, a second terminal component, and an elastic member. The first terminal component comprises a first flat terminal, which comprises a cable connecting end part and a first contacting end part. The second terminal component is disposed on one side of the first terminal component. The second terminal component comprises a second flat terminal including a second contacting end part and an electrical connecting end part. The first contacting end part is contacting with the second contacting end part. Two ends of the elastic member are respectively connected to the first terminal component and the second terminal component. The second terminal component is able to move toward or move away with respect to the first terminal component through the elastic member. The first contacting end part is frictionally contacting with the second contacting end part.

On the second aspect, the present disclosure provides an electrical connector, which comprises a housing and a terminal assembly according to the first aspect. The housing comprises a terminal accommodating through hole. The terminal assembly is disposed in the terminal accommodating through hole.

In the embodiments of the present disclosure, the second terminal component is able to move toward or move away with respect to the first terminal component through the elasticity of the elastic member, and the electrical connector using the terminal assembly of the present disclosure could be elastically in contact with a mating connector. In addition, terminals of the terminal assembly of the present disclosure are all flat-shaped, which could effectively reduce the size of the terminal assembly, thereby reducing the size of the electrical connector.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
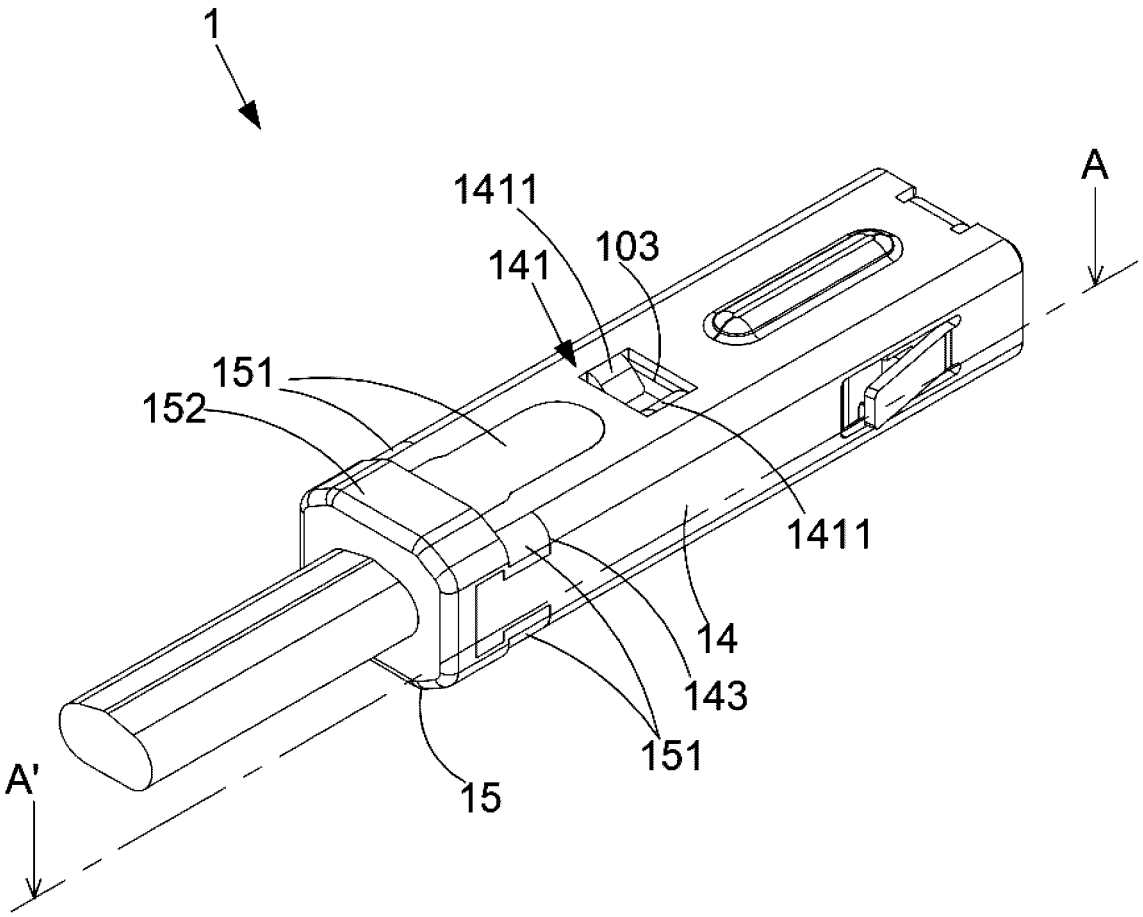
FIG. 1 is a perspective view of a terminal assembly of the first embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to member a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the disclosure.

Figure 2:
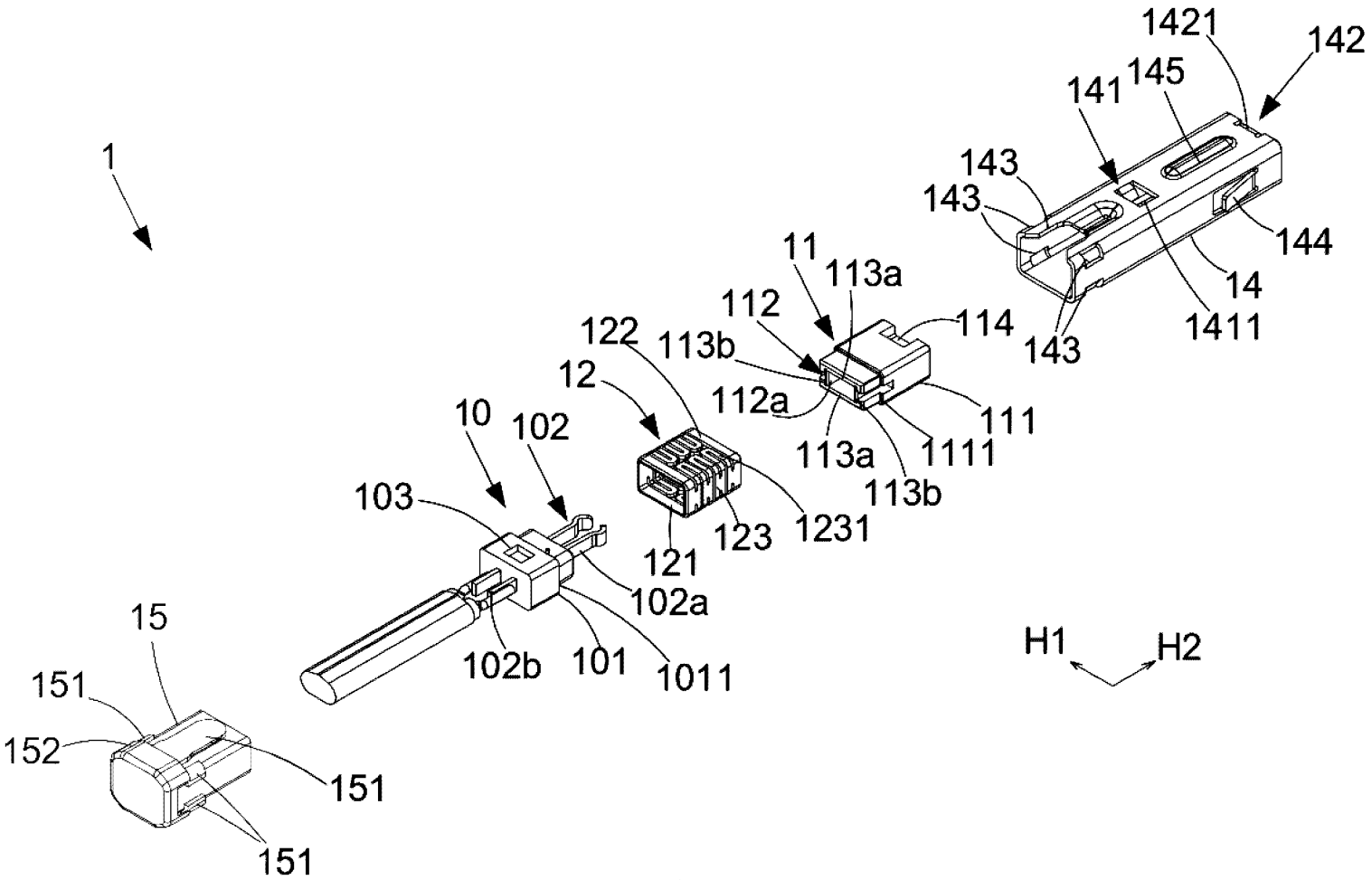
FIG. 2 is an exploded view of the terminal assembly of the first embodiment of the present disclosure.
Figure 3:
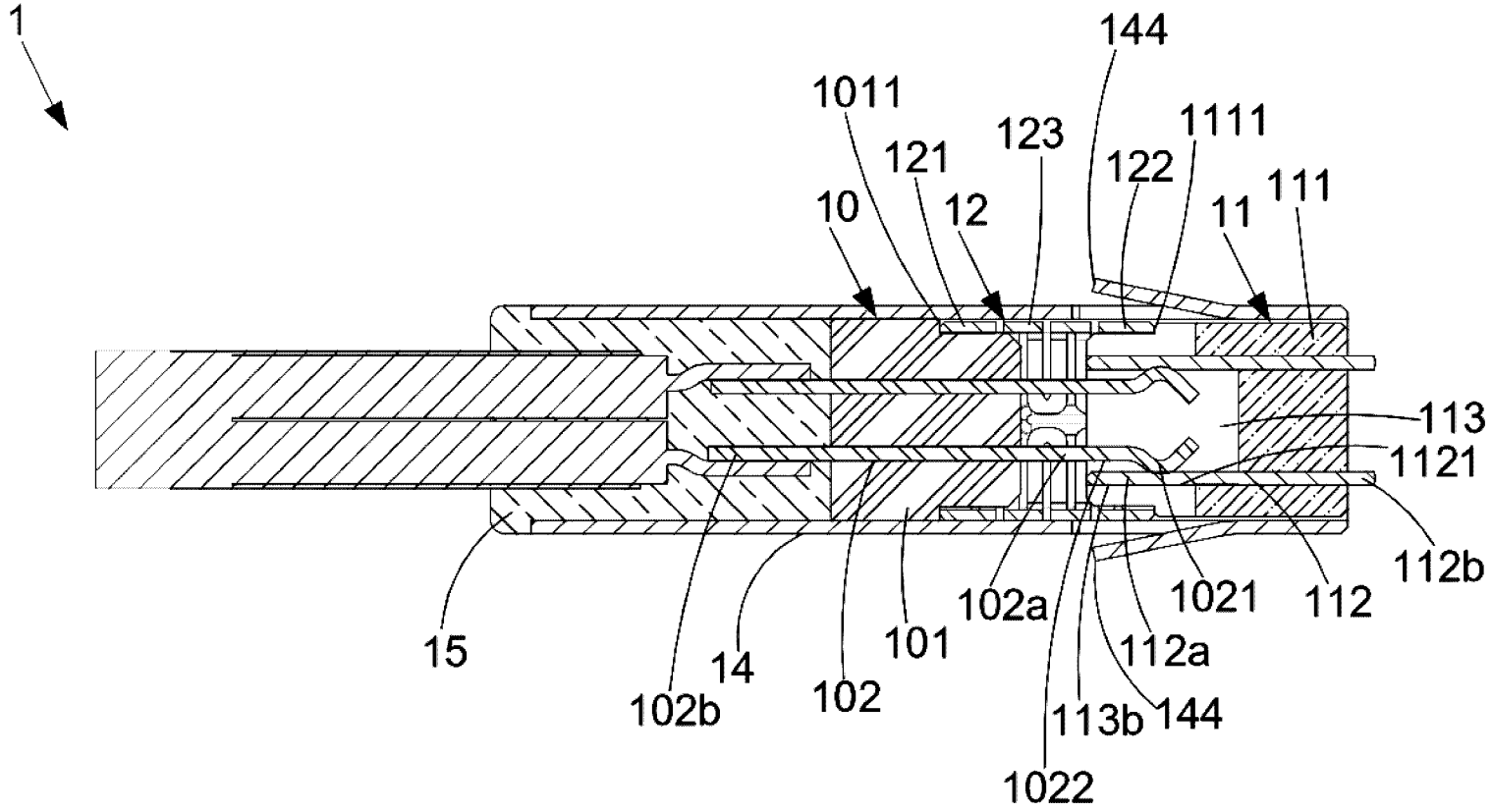
FIG. 3 is a cross-sectional view along line A-A' of FIG. 1.

FIG. 1 and FIG. 2 are perspective view and exploded view of a terminal assembly of the first embodiment of the present disclosure. FIG. 3 is a cross-sectional view along line A-A' of FIG. 1. As shown in the figure, the terminal assembly 1 of this embodiment comprises a first terminal component 10, a second terminal component 11, and an elastic member 12. The first terminal component 10 comprises a first insulator 101 and two first flat terminals 102 disposed in the first insulator 101 at intervals. Each of the first flat terminals 102 comprises a first contacting end part 102*a* and a cable connecting end part 102*b*. The first contacting end part 102*a* and the cable connecting end part 102*b* respectively protrude from two ends of the first insulator 101. The second terminal component 11 comprises a second insulator 111 and two second flat terminals 112 disposed in the second insulator 111 at intervals. Each of the second flat terminals 112 comprises a second contacting end part 112*a* and an electrical connecting end part 112*b*. The second contacting end part 112*a* is disposed in the second insulator 111. The electrical connecting end part 112*b* protrudes from one end of the second insulator 111.

The second terminal component 11 is disposed on one side of the first terminal component 10. The cable connecting end part 102*b* of each of the first flat terminals 102 of the first terminal component 10 extends in a direction away from the second terminal component 11. The first contacting end part 102*a* of each of the first flat terminals 102 of the first terminal component 10 extends in a direction close to the second terminal component 11, and is in contact with the second contacting end part 112*a* of the second flat terminal 112 of the second terminal component 11. In this embodiment, one end of the second insulator 111 close to the first terminal component 10 comprises a connecting slot 113. The second contacting end part 112*a* of each of the second flat terminals 112 is disposed in the connecting slot 113. The second contacting end part 112*a* is attached to a sidewall of the connecting slot 113. When the second terminal component 11 is installed on the first terminal component 10, the first contacting end part 102*a* of the first flat terminal 102 extends into the connecting slot 113 of the second insulator 111 and is in contact with the second contacting end part 112*a*. Thus, the sidewall of the connecting slot 113 could support the second contacting end part 112*a* to form and keep an excellent contact between the first contacting end part 102*a* and the second contacting end part 112*a*.

In this embodiment, one end of the first contacting end part 102*a* of each of the first flat terminals 102 close to the second terminal component 11 comprises a contacting bump 1021. The contacting bump 1021 of this embodiment is formed by bending one end of the first contacting end part 102*a* close to the second terminal component 11. The first contacting end part 102*a* of each of the first flat terminals 102 is in contact with the corresponding second contacting end part 112*a* of the second flat terminal 112 through the contacting bump 1021 ensuring the contacting between the first t contacting end part 102*a* and the second t contacting end part 112*a*.

In this embodiment, the sidewall of the connecting slot 113 comprises two first sidewalls 113*a* and two second sidewalls 113*b*. The two first sidewalls 113*a* are disposed oppositely, and the two second sidewalls 113*b* are disposed oppositely. Each of the second sidewalls 113*b* is disposed between two first sidewalls 113*a*. Each of the two first sidewalls 113*a* of this embodiment is parallel to the other first sidewall along a first horizontal direction H1, which is orthogonal to the two second sidewalls 113*b*. A surface 1121 of each of the second flat terminals 112 is attached to the corresponding second sidewall 113*b*, indicating that the surface 1121 of the second flat terminal 112 would be orthogonal to the first horizontal direction H1, and a surface 1022 of each of the first flat terminals 102 would be in contact with the surface 1121 of the corresponding second flat terminal 112. Thus, the surface 1022 of the first flat terminal 102 would also be orthogonal to the first horizontal direction H1.

The elastic member 12 is disposed between the first terminal component 10 and the second terminal component 11. In this embodiment, one end of the elastic member 12 is connected to the first insulator 101 of the first terminal component 10, and the other end of the elastic member 12 is connected to the second insulator 111 of the second terminal component 11. The second terminal component 11 could move close to or away from the first terminal component 10 through the elastic member 12, i.e., the second terminal component 11 is floating. When the second terminal component 11 moves close to or away from the first terminal component 10, the first contacting end part 102*a* would be frictionally contacting with the second contacting end part 112*a*.

The elastic member 12 of this embodiment is a hollow elastomer, wherein the first contacting end part 102*a* of each of the first flat terminals 102 passes through the elastic member 12 to contact the second contacting end part 112*a* of the second flat terminal 112 of the second terminal component 11. The elastic member 12 of this embodiment comprises a first elastic frame body 121, a second elastic frame body 122, and at least one elastomer 123. The first elastic frame body 121 is disposed opposite to the second elastic frame body 122. Two ends of the at least one elastomer 123 are respectively connected to the first elastic frame body 121 and the second elastic frame body 122. Each elastic body 123 comprises a plurality of bent parts 1231. Each of the bent parts is connected to other bent part(s). When the elastic member 12 is disposed between the first terminal component 10 and the second terminal component 11, the first elastic frame body 121 is connected to one end of the first insulator 101 of the first terminal component 10 close to the second terminal component 11, and the second elastic frame body 122 is connected to one end of the second insulator 111 of the second terminal component 11 close to the first terminal component 10. The elastomer 123 is disposed between the first insulator 101 and the second insulator 111. The plurality of bent parts 1231 are arranged along the horizontal movement direction of the second terminal component 11 (i.e., the second horizontal direction H2). In this way, the second terminal component 11 could linearly move with respect to the first terminal component 10 along the second horizontal direction H2 through the elastic member 12. In other words, the second terminal component 11 would not be skewed into other directions with respect to the first terminal component 10. The foregoing elastic member 12 is an embodiment of the present disclosure. The elastic member 12 of this embodiment can also be an elastic insulating block or a spring.

In this embodiment, one end of the first insulator 101 of the first terminal component 10 close to the second terminal component 11 comprises a first connecting recess 1011, and one end of the second insulator 111 of the second terminal component 11 close to the first terminal component 10 comprises a second connecting recess 1111, having the periphery of one end of the first insulator 101 close to the second terminal component 11 to be stair-shaped and the periphery of one end of the second insulator 111 close to the first terminal component 11 also to be stair-shaped. The first elastic frame body 121 of the elastic member 12 is disposed in the first connecting recess 1011 of the first insulator 101, and the second elastic frame body 122 of the elastic member 12 is disposed in the second connecting recess 1111 of the second insulator 111, having an outer surface of the elastic member 12 to be aligned with or lower than the outer surfaces of the first insulator 101 and the second insulator 111.

The terminal assembly 1 of this embodiment also comprises a housing 14, which accommodates the first terminal component 10, the second terminal component 11, and the elastic member 12. In this embodiment, a surface of the first insulator 101 of the first terminal component 10 comprises a positioning recess 103, and a positioning member 141 is provided on a surface of the housing 14. When the housing 14 is sleeved on the first terminal component 10, the positioning member 141 is disposed in the positioning recess 103 to secure the first terminal component 10 in the housing 14. In this embodiment, the positioning member 141 comprises two positioning elastic pieces 1411 oppositely disposed. The two positioning elastic pieces 1411 extend into the housing 14. The two positioning elastic pieces 1411 of this embodiment are manufactured by a process of stamping on a surface of the housing 14. When the positioning member 141 is disposed in the positioning recess 103, the two positioning elastic pieces 1411 respectively abut against a bottom surface of the positioning recess 103. In this embodiment, the number of positioning recesses 103 is two. The two positioning recesses 103 are respectively disposed on an upper surface and a lower surface of the first insulator 101, and thereby the number of positioning parts 141 is two. The two positioning members 141 are respectively disposed on an upper surface and a lower surface of the housing 14. The two positioning members 141 are respectively disposed in the corresponding positioning recess 103.

Figure 4:
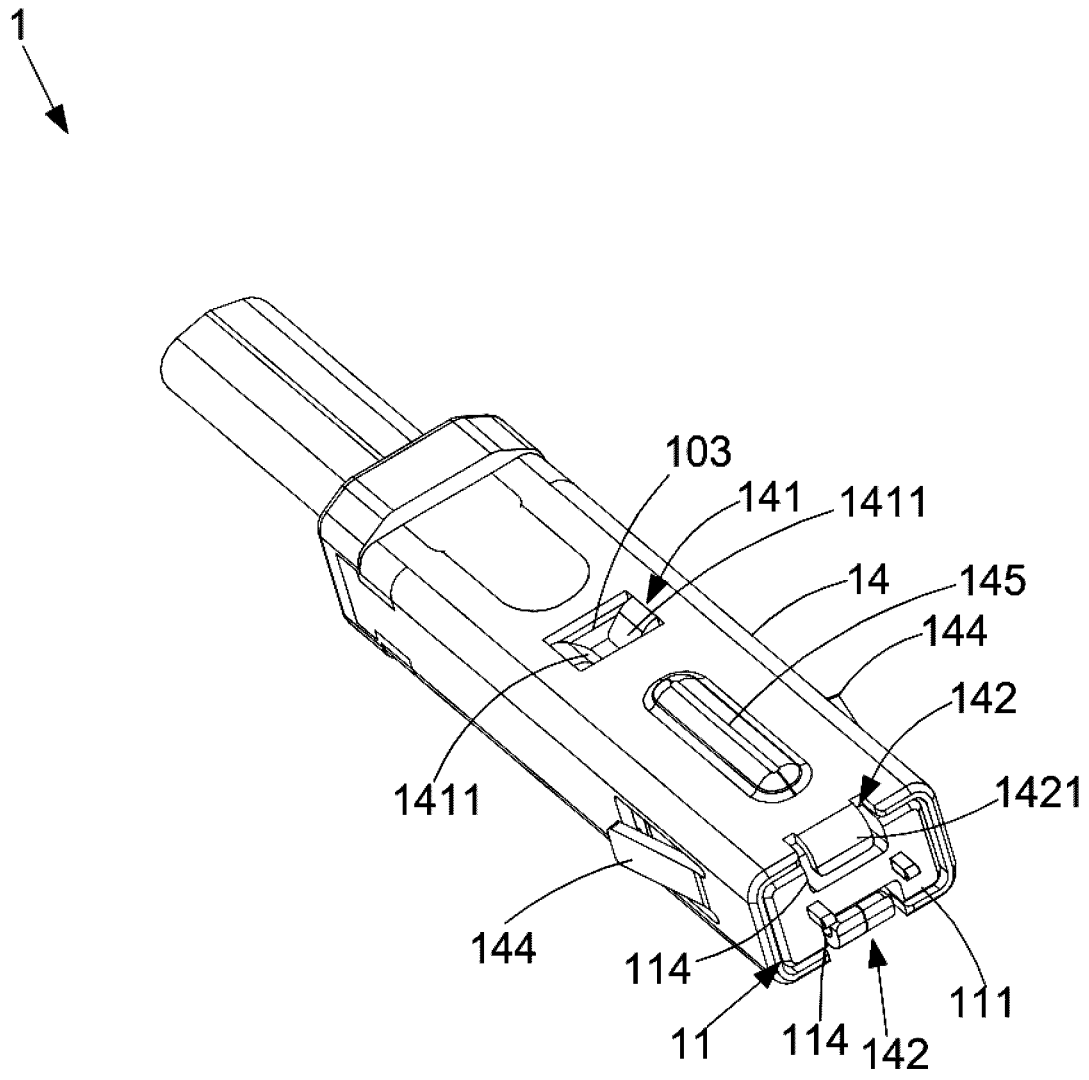
FIG. 4 is another perspective view of the terminal assembly of the first embodiment of the present disclosure.

FIG. 4 is another perspective view of the terminal assembly of the first embodiment of the present disclosure. As shown in the figure, in this embodiment, a limiting recess 114 is provided on a surface of the second insulator 111 of the second terminal component 11. The limiting recess 114 is disposed at one end of the second insulator 111 away from the first terminal component 10. A limiting member 142 is provided on a surface of the housing 14. The limiting member 142 is disposed at one end of the housing 14 away from the first terminal component 10. When the housing 14 is sleeved on the second terminal component 11, the limiting member 142 is disposed in the limiting recess 114 to prevent the second terminal component 11 from moving in a direction away from the first terminal component 10 (ie, the second horizontal direction H2, wherein the second horizontal direction H2 is orthogonal to the first horizontal direction H1). The limiting member 142 of this embodiment comprises a limiting elastic piece 1421 extending into the housing 14. In this embodiment, the limiting elastic piece 1421 is manufactured by a process of stamping on a surface of the housing 14. When the limiting member 142 is disposed in the limiting recess 114, the limiting elastic piece 1421 is disposed in the limiting recess 114. In this embodiment, the number of limiting recesses 114 is two. The two limiting recesses 114 are respectively disposed on an upper surface and a lower surface of the second insulator 111, thereby the number of limiting members 142 is two. The two limiting members 142 are respectively disposed on an upper surface and a lower surface of the housing 14, and are respectively disposed in the corresponding limiting recesses 114.

In this embodiment, the cable connecting end part 102*b* of the first terminal component 10 is connected to a cable. The terminal assembly 1 of this embodiment also comprises a covering member 15. The covering member 15 is disposed on the housing 14 and covers the connection between the cable connecting end part 102*b* and the cable. One end of the covering member 15 abuts against the first insulator 101 of the first terminal component 10, and the cable passes through the other end of the covering member 15. In this embodiment, the covering member 15 is disposed on the housing 14 by insert molding. That is, the covering member 15 would be formed on the housing 14 after the housing 14 is installed on the first terminal component 10, the second terminal component 11, and the elastic member 12.

In this embodiment, one end of the housing 14 away from the second terminal component 11 comprises a plurality of securing holes 143 respectively disposed on a plurality of sides, an upper surface, and a lower surface of the housing 14. When the covering member 15 is formed on the housing 14, the covering member 15 would comprise a plurality of securing bumps 151 disposed in the plurality of securing holes 143 to secure the housing 14 onto the covering member 15. The covering member 15 further comprises a covering bump 152. The covering bump 152 is disposed on one end of the covering member 15 away from the first terminal component 10, and covers the housing 14 to effectively increase the connection stability between the covering member 15 and the housing 14.

Figure 5:
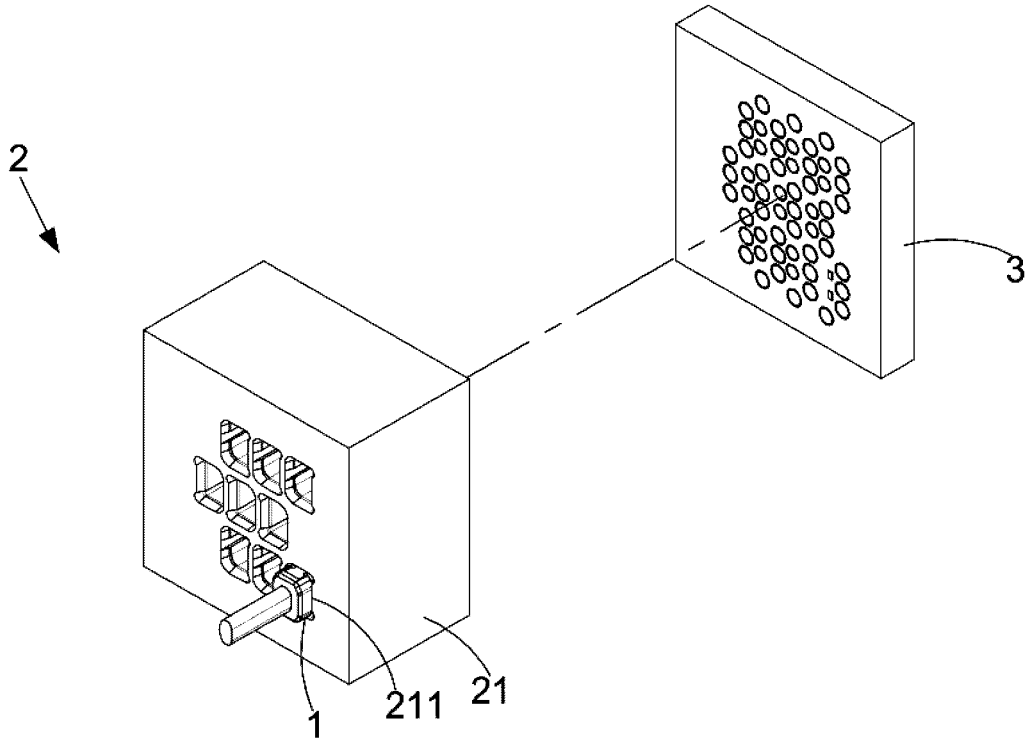
FIG. 5 is a perspective view of an electrical connector of the first embodiment of the present disclosure.
Figure 6:
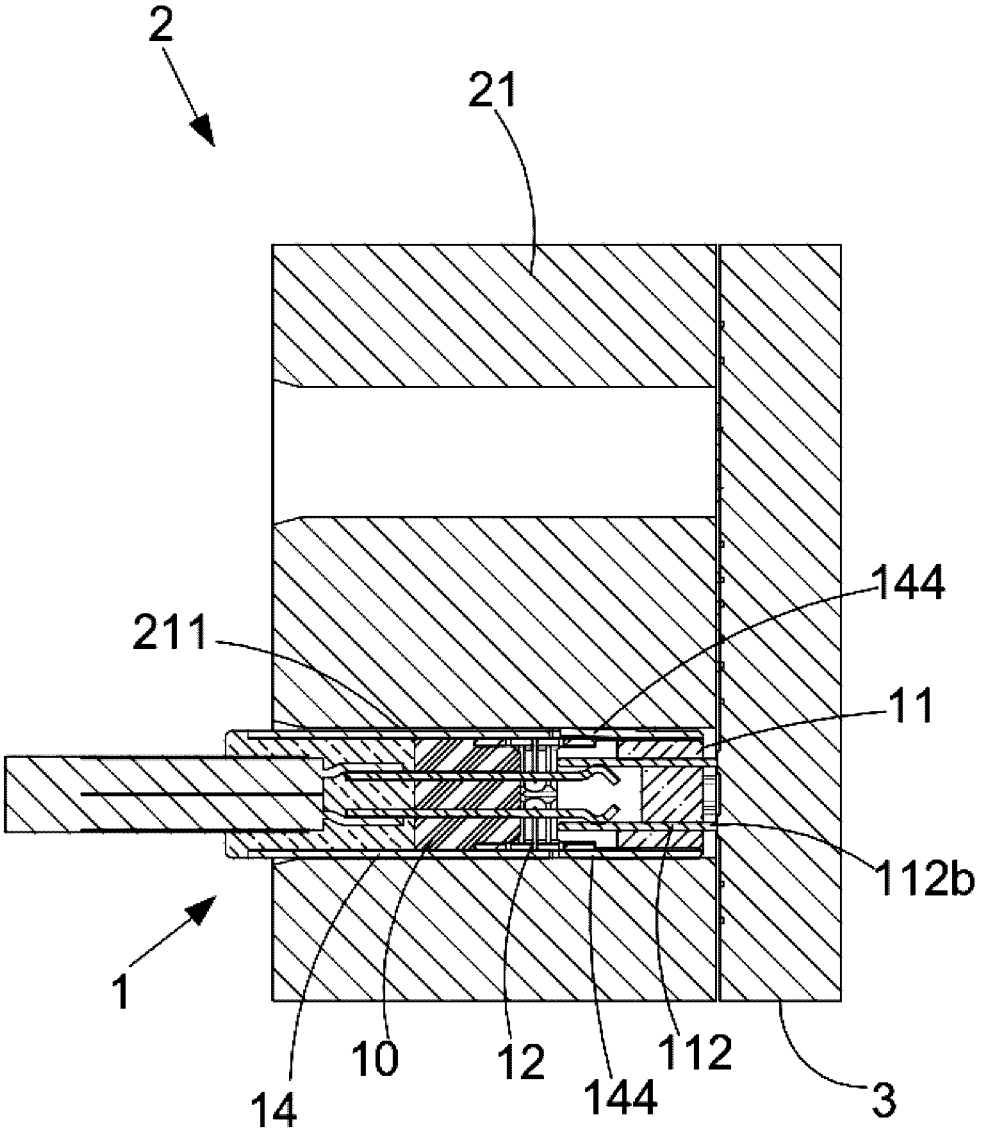
FIG. 6 is a cross-sectional view of the electrical connector of the first embodiment of the present disclosure.

The terminal assembly 1 of this embodiment could be applied to electrical connectors. FIG. 5 and FIG. 6 are perspective view and cross-sectional view of an electrical connector of the first embodiment of the present disclosure. As shown in the figure, the electrical connector 2 of this embodiment comprises a housing 21 and the terminal assembly 1 of the first embodiment. The housing 21 comprises a terminal accommodating through hole 211. The terminal assembly 1 is disposed in the terminal accommodating through hole 211. The first terminal component 10 of each of the terminal assemblies 1 is secured on the housing 21. When the electrical connector 2 is connected to the mating connector 3 (circuit board), an electrical connecting end part 112*b* of each of the second flat terminals 112 of the second terminal component 11 abuts against the mating connector 3. The electrical connecting end part 112*b* is in contact with the mating connector 3 to make the second terminal component 11 approach the first terminal component 10. So, the second terminal component 11 would compress the elastic member 12 while approaching the first terminal component 10, then the compressed elastic member 12 supports the second terminal component 11. When the electrical connector 2 is detached from the mating connector 3, the compressed elastic member 12 would be released, and an elastic force from the elastic member 12 pushes the second terminal component 11 to move in a direction away from the first terminal component 10, restoring the second terminal component 11 to the original position. It can be seen from the above that the electrical connector 2 using the terminal assembly 1 of this embodiment is able to elastically contact with the mating connector 3. The elastic contact of this embodiment is performed by firstly the mating connector 3 pushes the second terminal component 11, then the second terminal component 11 compresses the elastic member 12, and finally the compressed elastic member 12 supports the second terminal component 11. Thus, in this embodiment, the terminal of the terminal assembly 1 of this embodiment is not provided with any elastic contacts to achieve elastic contact. The terminals of the terminal assembly 1 of this embodiment are flat terminals which could effectively reduce the size of the terminal assembly 1 as well as the size of the electrical connector 2.

In this embodiment, the housing 14 of the terminal assembly 1 comprises two abutting elastic pieces 144. One ends of the two abutting elastic pieces 144 are disposed on two opposite sides of the housing 14. The two abutting elastic pieces 144 extend in a direction away from the housing 14. When the terminal assembly 1 is disposed in the terminal accommodating through hole 211, one ends of the two abutting elastic pieces 144 away from the housing 14 would abut against two opposite sidewalls of the terminal accommodating through hole 211 to secure the terminal assembly 1 in the housing 14. The housing 14 of this embodiment also comprises a limiting bump 145. The limiting bump 145 is disposed on a surface of the housing 14 and is disposed at one end of the housing 14 away from the first terminal component 10, i.e., corresponding to the second terminal component 11. When the terminal assembly 1 is disposed in the terminal accommodating through hole 211, the limiting bump 145 also abuts against the sidewall of the terminal accommodating through hole 211. The housing 14 is secured in the terminal accommodating through hole 211 through the two abutting elastic pieces 144 and the limiting bump 145. Thus, this can effectively prevent the terminal assembly 1 from detaching from the terminal accommodating through hole 211 when it is inserted into the mating connector 3.

Figure 7:
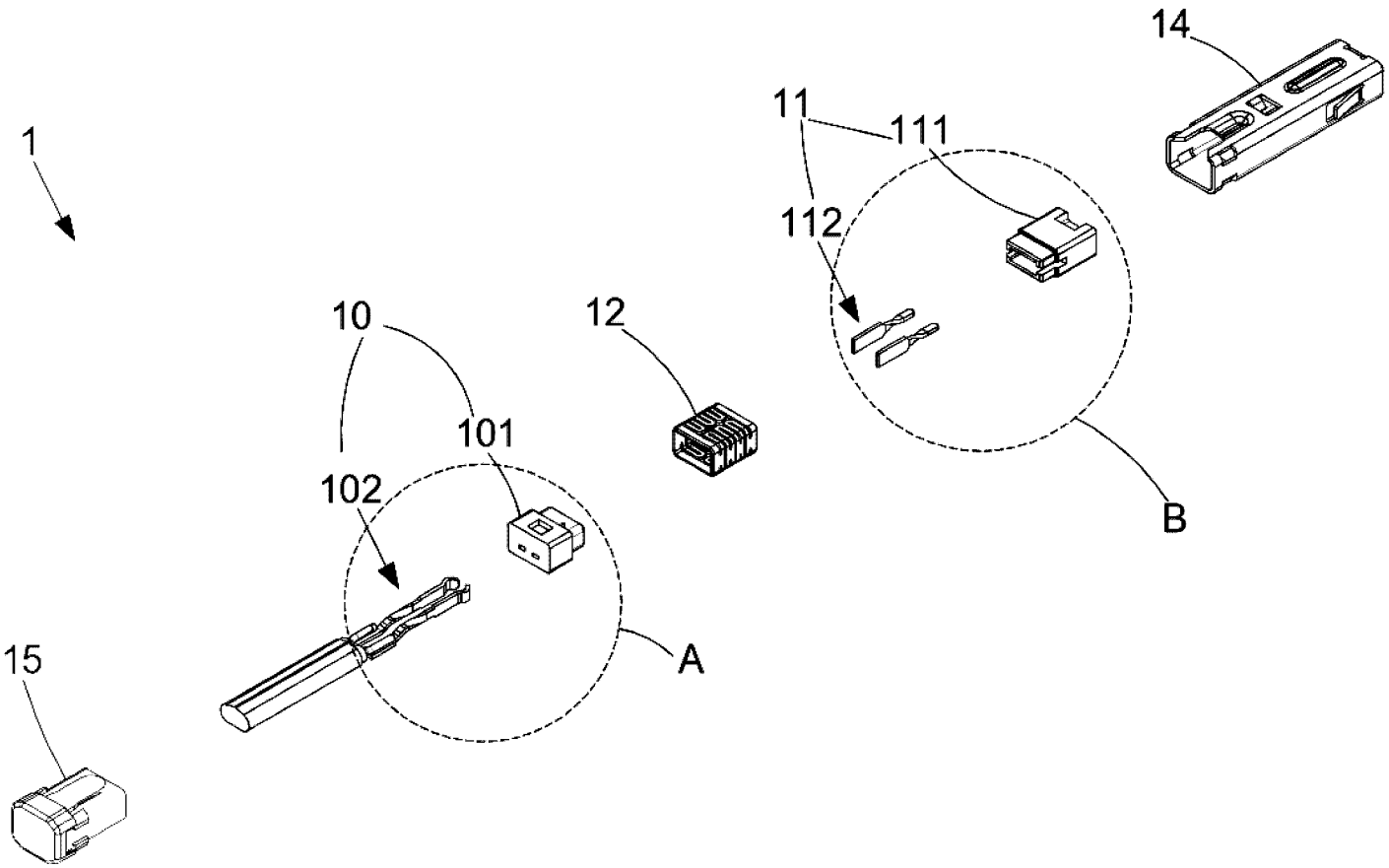
FIG. 7 is an exploded view of a terminal assembly of the second embodiment of the present disclosure.
Figure 8:
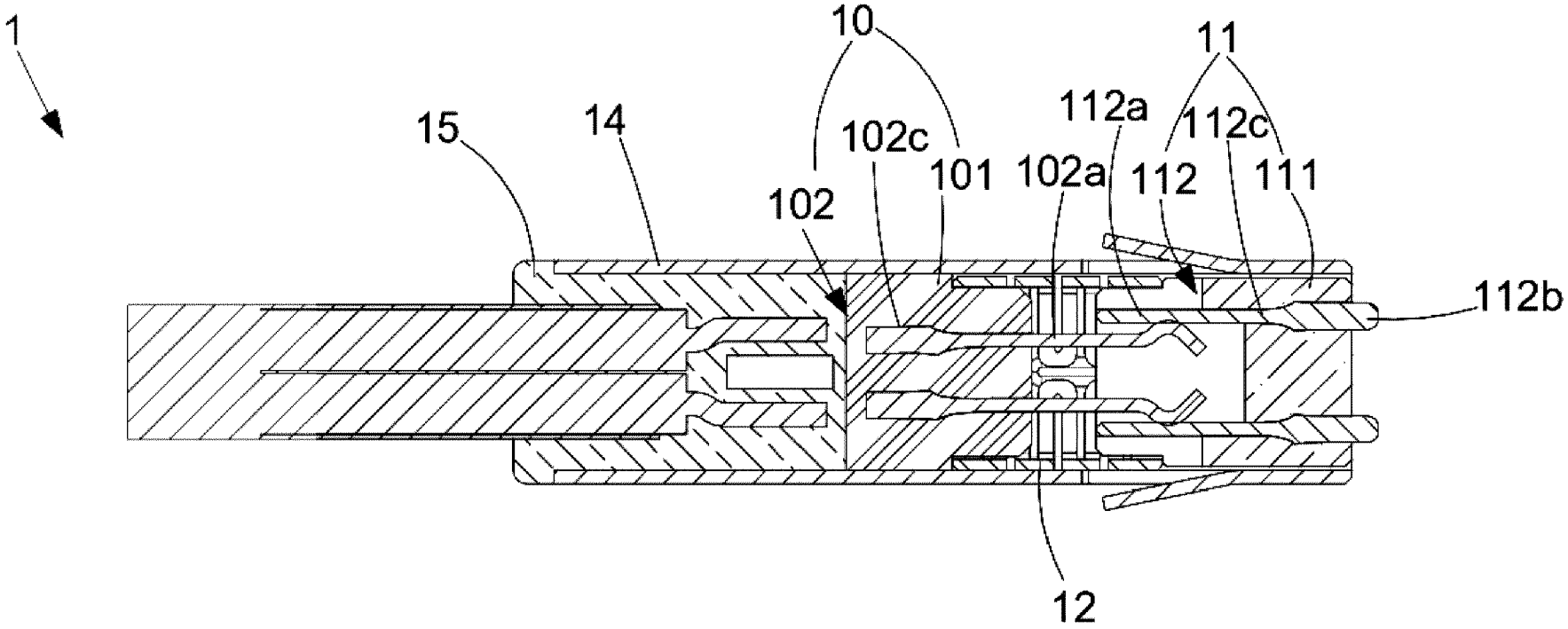
FIG. 8 is a cross-sectional view of the terminal assembly of the second embodiment of the present disclosure.
Figure 9:
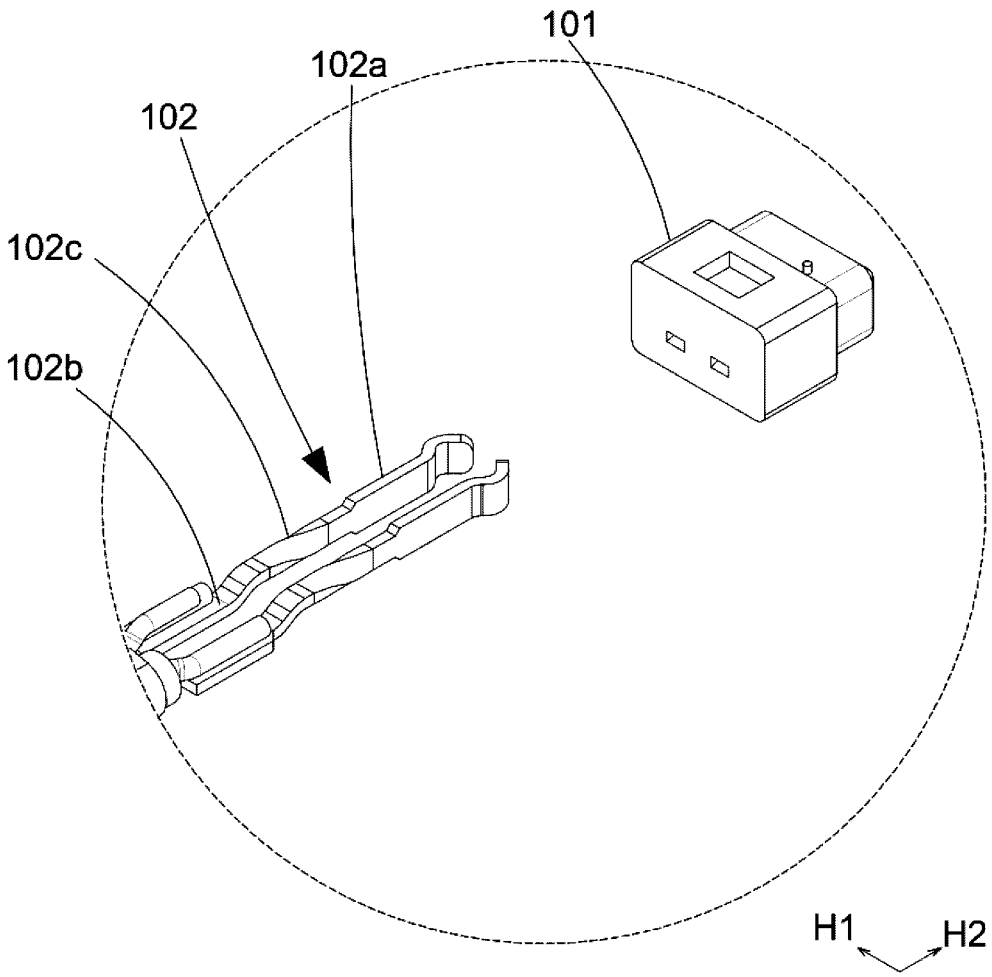
FIG. 9 is an enlarged view of area A of FIG. 7.

FIG. 7 and FIG. 8 are exploded view and cross-sectional view of a terminal assembly of the second embodiment of the present disclosure. FIG. 9 is an enlarged view of area A of FIG. 7. As shown in the figure, the terminal assembly 1 of this embodiment is different from that of the first embodiment in that the first flat terminal 102 of the first terminal component 10 of the terminal assembly 1 comprises a first twist securing 102*c*. Two ends of the first twist securing 102*c* are respectively connected to a first contacting end part 102*a* and a cable connecting end part 102*b*. The first twist securing 102*c* is disposed in the first insulator 101. The first twist securing 102*c* is formed by twisting the center part of a flat body of the first flat terminal 102. The first twist securing 102*c* is able to make a surface of the first contacting end part 102*a* to be orthogonal to a surface of the cable connecting end part 102*b*. In this embodiment, since the surface of the cable connecting end part 102*b* is parallel to a first horizontal direction H1, and the surface of the first contacting end part 102*a* is orthogonal to the first horizontal direction H1, the surface of the first contacting end part 102*a* could be orthogonal to the surface of the cable connecting end part 102*b*. So, the width of the first insulator 101 in the first horizontal direction H1 could be reduced, and the width of the first terminal component 10 can be further reduced. The foregoing surface of the first contacting end part 102*a* and the cable connecting end part 102*b* are both referred to a surface having the largest surface area among the surfaces of the first flat terminal 102 (the upper surface and the lower surface shown in the figures).

Figure 10:
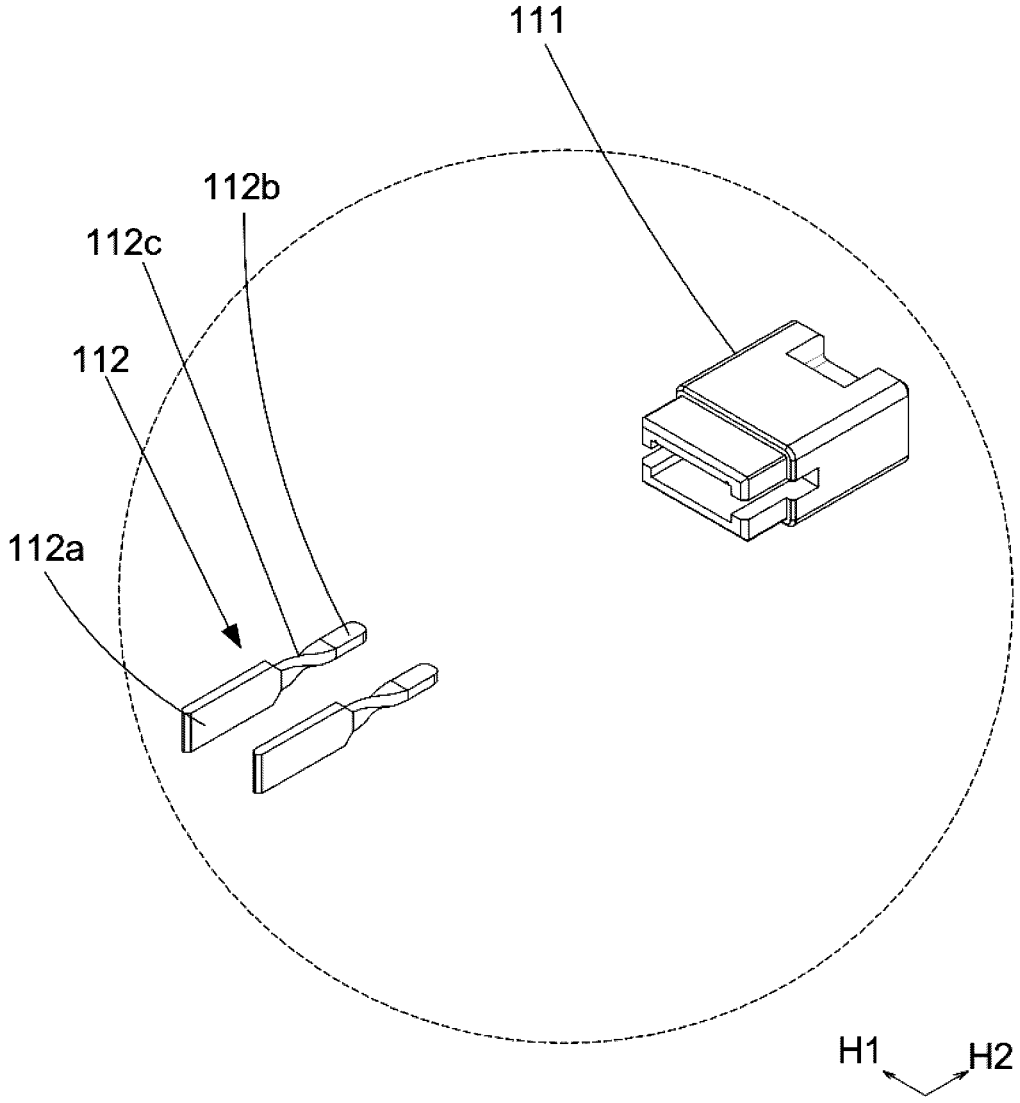
FIG. 10 is an enlarged view of area B of FIG. 7.

FIG. 10 is an enlarged view of area B of FIG. 7. As shown in the figure, the second flat terminal 112 of the second terminal component 11 of the terminal assembly 1 of this embodiment comprises a second twist securing 112*c*. Two ends of the second twist securing 112*c* are respectively connected to a second contacting end part 112*a* and an electrical connecting end part 112*b*. The second twist securing 112*c* is disposed in the second insulator 111. The second twist securing 112*c* is formed by twisting the center part of the flat body of the second flat terminal 112. The second twist securing 112*c* is able to make the surface of the second contacting end part 112*a* to be orthogonal to the surface of the electrical connecting end part 112*b*. In this embodiment, the surface of the second contacting end part 112*a* is orthogonal to the first horizontal direction H1, i.e., parallel to the surface of the first contacting end part 102*a*. The surface of the electrical connecting end part 112*b* is parallel to the first horizontal direction H1, thereby the width of the second insulator 111 in the first horizontal direction H1 can be reduced, and the width of the second terminal component 11 in the first horizontal direction H1 can also be reduced. Meanwhile, the width of the surface of the electrical connecting end part 112*b* is narrower than the width of the surface of the second contacting end part 112*a*. The width of the electrical connecting end part 112*b* is reduced without increasing the width of the second terminal component 11 in the first horizontal direction H1.

It can be seen from the above that through the arrangement of the first twist securing 102*c* of each of the first flat terminals 102 of the first terminal component 10 and the second twist securing 112*c* of each of the second flat terminals 112 of the second terminal component 11, the width of the first terminal component 10 in the first horizontal direction H1 and the width of the second terminal component 11 in the first horizontal direction H1 can be reduced, so that the width of the elastic member 12, the housing 14 and the covering member 15 as well as the width of the entire terminal assembly 1 in the first horizontal direction H1 can also be reduced. Thus, the size of the entire terminal assembly 1 can be reduced.

In summary, the present disclosure proposed a terminal assembly and electrical connector. The second terminal component is able to move toward or move away with respect to the first terminal component through the elasticity of the elastic member, and the electrical connector using the terminal assembly of the present disclosure could be elastically in contact with a mating connector. In addition, terminals of the terminal assembly of the present disclosure are all flat-shaped, which could effectively reduce the size of the terminal assembly, thereby reducing the size of the electrical connector.

It is to be understood that the term "comprises", "comprising", or any other variants thereof, is intended to encompass a non-exclusive inclusion, such that a process, method, article, or device of a series of elements not only include those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A terminal assembly, comprising:

a first terminal component comprising a first flat terminal, the first flat terminal comprising a cable connecting end part and a first contacting end part; a second terminal component disposed on one side of the first terminal component, the second terminal component comprising a second flat terminal including a second contacting end part and an electrical connecting end part, the first contacting end part contacting with the second contacting end part; an elastic member, two ends of which being respectively connected to the first terminal component and the second terminal component, the second terminal component being able to move toward or move away with respect to the first terminal component through the elastic member, the first contacting end part frictionally contacting with the second contacting end part, wherein the first terminal component further comprises a first insulator on which the first flat terminal is disposed; the cable connecting end part and the first contacting end part respectively protrude from the first insulator; the second terminal component further comprises a second insulator on which the second flat terminal is disposed; the electrical connecting end part protrudes from the second insulator; two ends of the elastic member are respectively connected to the first insulator and the second insulator.

2. The terminal assembly according to claim 1, wherein one end of the second insulator close to the first terminal component comprises a connecting slot; the second contacting end part is disposed in the connecting slot.

3. The terminal assembly according to claim 2, wherein the second contacting end part is attached to a sidewall of the connecting slot.

4. The terminal assembly according to claim 1, wherein the first flat terminal comprises a first twist part; two ends of the first twist part are respectively connected to the first contacting end part and the cable connecting end part; the first twist part is disposed in the first insulator; a surface of the first contacting end part is orthogonal to a surface of the cable connecting end part; the second flat terminal comprises a second twist part; two ends of the second twist part are respectively connected to the second contacting end part and the electrical connecting end part; the second twist part is disposed in the second insulator; a surface of the second contacting end part is orthogonal to a surface of the electrical connecting end part; the surface of the first contacting end part is parallel to the surface of the second contacting end part.

5. The terminal assembly according to claim 4, wherein the surface of the first contacting end part and the surface of the second contacting end part are orthogonal to a horizontal direction perpendicular to the horizontal movement direction of the second terminal component; the surface of the cable connecting end part and the surface of the electrical connecting end part are parallel to the horizontal direction.

6. The terminal assembly according to claim 4, wherein the width of the surface of the electrical connecting end part is narrower than the width of the surface of the second contacting end part.

7. The terminal assembly according to claim 1, wherein the elastic member is a hollow elastomer; the first contacting end part passes through the elastic member to be contacted with the second contacting end part.

8. The terminal assembly according to claim 7, wherein the elastic member comprises a first elastic frame body, a second elastic frame body and an elastomer; two ends of the elastomer are respectively connected to the first elastic frame body and the second elastic frame body; the first elastic frame body is connected to the first insulator; the second elastic frame body is connected to the second insulator.

9. The terminal assembly according to claim 8, wherein the elastomer comprises a plurality of bent parts; each of the bent parts is connected to other bent part(s); the plurality of bent parts are arranged along a horizontal movement direction of the second terminal component.

10. The terminal assembly according to claim 8, wherein one end of the first insulator close to the second terminal component comprises a first connecting recess; one end of the second insulator close to the first terminal component comprises a second connecting recess; the first elastic frame body is disposed in the first connecting recess; the second elastic frame body is disposed in the second connecting recess.

11. The terminal assembly according to claim 1 further comprising a housing accommodates the first terminal component, the second terminal component, and the elastic member.

12. The terminal assembly according to claim 11, wherein a surface of the first insulator is provided with a positioning recess; a surface of the housing is provided with a positioning member; the positioning member is disposed in the positioning recess.

13. The terminal assembly according to claim 12, wherein the positioning member comprises two positioning elastic pieces oppositely disposed; the two positioning elastic pieces extend into the housing and are disposed in the positioning recess; the two positioning elastic pieces abut against a bottom surface of the positioning recess.

14. The terminal assembly according to claim 11, wherein a surface of the second insulator is provided with a limiting recess; a surface of the housing is provided with a limiting member; the limiting member is disposed at one end of the housing away from the first terminal component; the limiting member is disposed in the limiting recess.

15. The terminal assembly according to claim 14, wherein the limiting member comprises a limiting elastic piece; the limiting elastic piece extends into the housing and is disposed in the limiting recess.

16. The terminal assembly according to claim 11 further comprising a covering member disposed on the housing; the covering member covers the connection between the cable connecting end part and a cable; one end of the covering member abuts against the first insulator; the cable passes through the other end of the covering.

17. The terminal assembly according to claim 16, wherein the housing comprises a plurality of securing holes; the covering member comprises a plurality of securing bumps disposed in the plurality of securing holes.

18. The terminal assembly according to claim 17, wherein the covering member comprises a covering bump disposed on one end of the covering member away from the first terminal component; the covering bump covers the housing.

19. The terminal assembly according to claim 1, wherein one end of the first contacting end part close to the second terminal component comprises a contacting bump in contact with the second contacting end part.

20. An electrical connector, comprising: a housing comprising a terminal accommodating through hole; a terminal assembly, comprising: a first terminal component comprising a first flat terminal, the first flat terminal comprising a cable connecting end part and a first contacting end part; a second terminal component disposed on one side of the first terminal component, the second terminal component comprising a second flat terminal including a second contacting end part and an electrical connecting end part, the first contacting end part contacting with the second contacting end part; an elastic member, two ends of which being respectively connected to the first terminal component and the second terminal component, the second terminal component being able to move toward or move away with respect to the first terminal component through the elastic member, the first contacting end part frictionally contacting with the second contacting end part; wherein the terminal assembly is disposed in the terminal accommodating through hole, wherein the first terminal component further comprises a first insulator on which the first flat terminal is disposed; the cable connecting end part and the first contacting end part respectively protrude from the first insulator; the second terminal component further comprises a second insulator on which the second flat terminal is disposed; the electrical connecting end part protrudes from the second insulator; two ends of the elastic member are respectively connected to the first insulator and the second insulator.

* * * * *